US007520007B2

(12) United States Patent
Skripps

(10) Patent No.: US 7,520,007 B2
(45) Date of Patent: Apr. 21, 2009

(54) ACCESSORY RAIL CLAMP WITH LATCH AND LOCK MECHANISMS

(75) Inventor: Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 352 days.

(21) Appl. No.: 11/402,331

(22) Filed: Apr. 11, 2006

(65) Prior Publication Data

US 2006/0255220 A1 Nov. 16, 2006

Related U.S. Application Data

(63) Continuation-in-part of application No. 11/229,759, filed on Sep. 19, 2005.

(60) Provisional application No. 60/670,027, filed on Apr. 11, 2005, provisional application No. 60/670,040, filed on Apr. 11, 2005, provisional application No. 60/670,041, filed on Apr. 11, 2005, provisional application No. 60/720,598, filed on Sep. 26, 2005, provisional application No. 60/626,627, filed on Nov. 10, 2004.

(51) Int. Cl.
*A61G 13/12* (2006.01)

(52) U.S. Cl. ..... 5/621; 24/459; 248/316.6; 248/229.14

(58) Field of Classification Search ..... 5/621–624; 108/27–28; 24/455, 459; 248/316.1, 6, 229.14
See application file for complete search history.

(56) References Cited

U.S. PATENT DOCUMENTS 2,509,086 A 5/1950 Eaton
2,935,286 A 5/1960 Parsons
3,046,072 A 7/1962 Douglass, Jr. et al.
3,099,441 A 7/1963 Ries
3,188,079 A 6/1965 Boetcker et al.
3,828,377 A 8/1974 Fary, Sr.
3,947,686 A 3/1976 Cooper et al.
4,018,412 A 4/1977 Kees, Jr. et al.

(Continued)

FOREIGN PATENT DOCUMENTS

WO 2005/020819 A1 3/2005

OTHER PUBLICATIONS

2005 Catalog Passionate About Positioning, Allen Medical Systems, A Hill-Rom Company.

*Primary Examiner*—Fredrick Conley
(74) *Attorney, Agent, or Firm*—Barnes & Thornburg LLP

(57) ABSTRACT

A clamp is provided for securing an accessory to a rail of a patient support apparatus. The clamp comprises a first jaw adapted to be placed on the rail, a second jaw coupled to the first jaw for movement between an open position and a closed position, a resilient member that is forced against the rail when the second jaw is moved from the open position to the closed position, and a latch coupled to the second jaw and movable relative to the second jaw between a latched position in which the second jaw is locked in the closed position relative to the first jaw and an unlatched position in which the second jaw is movable between the open and closed positions. The resilient member engages the rail with sufficient force to inhibit movement of the clamp along the rail when the second jaw is in the closed position.

18 Claims, 4 Drawing Sheets

U.S. PATENT DOCUMENTS

| | | | | |
|---|---|---|---|---|
| 4,054,282 | A | 10/1977 | Hamer | |
| 4,108,426 | A | 8/1978 | Lindstroem et al. | |
| 4,139,917 | A | 2/1979 | Fenwick | |
| 4,143,652 | A | 3/1979 | Meier et al. | |
| 4,225,125 | A | 9/1980 | Lee | |
| 4,355,631 | A | 10/1982 | LeVahn | |
| 4,383,351 | A | 5/1983 | Fenwick | |
| 4,474,364 | A | 10/1984 | Brendgord | |
| 4,484,911 | A | 11/1984 | Berlin et al. | |
| 4,487,523 | A | 12/1984 | Monroe | |
| 4,506,872 | A | 3/1985 | Westerberg et al. | |
| 4,526,355 | A | 7/1985 | Moore et al. | |
| 4,583,725 | A | 4/1986 | Arnold | |
| 4,671,728 | A | 6/1987 | Clark et al. | |
| 4,729,535 | A | 3/1988 | Frazier et al. | |
| 4,796,846 | A | 1/1989 | Meier et al. | |
| 4,840,363 | A | 6/1989 | McConnell | |
| 4,852,840 | A | 8/1989 | Marks | |
| 4,901,963 | A | 2/1990 | Yoder | |
| 4,901,964 | A | 2/1990 | McConnell | |
| 4,923,187 | A | 5/1990 | Mombrinie | |
| 4,971,037 | A | 11/1990 | Pelta | |
| 4,989,848 | A | 2/1991 | Monroe | |
| 5,088,706 | A | 2/1992 | Jackson | |
| 5,108,213 | A | 4/1992 | Shields | |
| 5,121,892 | A | 6/1992 | Herzog | |
| 5,131,106 | A | 7/1992 | Jackson | |
| 5,135,210 | A | 8/1992 | Michelson | |
| 5,276,927 | A | 1/1994 | Day | |
| 5,287,575 | A | 2/1994 | Allen et al. | |
| 5,320,444 | A | 6/1994 | Bookwalter et al. | |
| 5,400,772 | A | 3/1995 | LeVahn et al. | |
| 5,444,882 | A | 8/1995 | Andrews et al. | |
| 5,538,215 | A | 7/1996 | Hosey | |
| 5,613,254 | A | 3/1997 | Clayman et al. | |
| 5,658,315 | A | 8/1997 | Lamb et al. | |
| 5,701,991 | A | 12/1997 | Helmetsie | |
| 5,741,210 | A | 4/1998 | Dobrovolny | |
| 5,758,374 | A | 6/1998 | Ronci | |
| 5,836,026 | A | 11/1998 | Reed | |
| 5,836,559 | A | 11/1998 | Ronci | |
| 5,926,876 | A | 7/1999 | Haigh et al. | |
| 6,120,397 | A | 9/2000 | Julian | |
| 6,260,220 | B1 | 7/2001 | Lamb et al. | |
| 6,382,576 | B1 | 5/2002 | Heimbrock | |
| 6,490,737 | B1 | 12/2002 | Mazzei et al. | |
| 6,622,980 | B2 * | 9/2003 | Boucher et al. | 248/231.51 |
| 6,663,055 | B2 | 12/2003 | Boucher et al. | |
| 6,691,350 | B2 | 2/2004 | Weismiller | |
| 6,754,923 | B2 | 6/2004 | Borders et al. | |
| 2002/0061225 | A1 | 5/2002 | Boucher et al. | |
| 2004/0123389 | A1 | 7/2004 | Boucher et al. | |

* cited by examiner

ACCESSORY RAIL CLAMP WITH LATCH AND LOCK MECHANISMS

This application claims the benefit, under 35 U.S.C. § 119(e), of U.S. Provisional Patent Application Nos. 60/670,027, 60/670,040, and 60/670,041 all three of which were filed Apr. 11, 2005; and of U.S. Provisional Patent Application No. 60/720,598 which was filed Sep. 26, 2005. This application is also a continuation-in-part of U.S. application Ser. No. 11/229,759 which was filed Sep. 19, 2005 and which claimed the benefit, under 35 U.S.C. § 119(e), of U.S. Provisional Patent Application No. 60/626,627 which was filed Nov. 10, 2004. U.S. Provisional Application Nos. 60/670,027; 60/670,040; 60/670,041; 60/720,598 and U.S. application Ser. No. 11/229,759 are hereby expressly incorporated by reference herein.

BACKGROUND OF THE INVENTION

The present disclosure relates to clamps that attach to rails, and particularly to clamps that attach to accessory rails of surgical tables to support accessories used during surgical procedures. More particularly, the present disclosure relates to rail clamps having movable jaws that permit the clamps to couple to accessory rails without having to slide the clamp onto the rail from an end of the rail.

Accessory rail clamps to attach accessories, such as leg stirrups and arm boards, to accessory rails of surgical tables are known. See, for example, U.S. Pat. No. 6,622,980. While many surgical tables have accessory rails of a common size, some specialized surgical tables have been developed which do not include these standard-size accessory rails, but instead have frame members (also considered to be rails according to this disclosure) of different sizes to which patient support devices or other surgical equipment may attach. For example, specialized orthopedic surgical tables have been developed for orthopedic surgery and a subset of these specialized orthopedic surgical tables, referred to in the art as "Jackson" tables, have been designed specifically for spinal surgery. Examples of the "Jackson" table may be found in U.S. Pat. Nos. 5,088,706; 5,131,106; 5,613,254; and 6,260,220. Because accessory rails of surgical tables are typically made of metal, such as stainless steel, and because it is desirable for tables used in orthopedic procedures to be substantially radiolucent so that x-ray images and fluoroscopic images of patients may be taken during surgical procedures, most Jackson tables do not have standard-size accessory rails.

Many of the devices and accessories which attach to accessory rails of surgical tables, including frame members of Jackson tables, rely on one or more threaded screws to clamp against the rail or to act upon some other member that clamps against the rail. It is not uncommon for multiple accessories to be attached to accessory rails during surgery. It can become cumbersome and time consuming to screw and unscrew the multitude of threaded screws associated with such a multitude of accessories if, for example, one or more of the accessories need to be repositioned along the rail before or during a surgical procedure. Furthermore, some caregivers may tighten a screw of an accessory to such an extent that other caregivers with less strength may have difficulty in loosening, or are completely unable to loosen, the threaded screw. Accordingly, there is a need for a accessory rail clamp that clamps onto, and unclamps from, an accessory rail quickly and easily and that, when clamped, has a fairly repeatable and consistent amount of clamping force.

SUMMARY OF THE INVENTION

The present invention comprises a clamp having one or more of the features listed in the appended claims, or one or more of following features or combinations thereof, which alone or in any combination may comprise patentable subject matter:

A clamp is provided for securing an accessory, such as a head support apparatus, to a rail of a patient support apparatus, such as a spinal surgery extension. The clamp may comprise a first or fixed jaw adapted to be placed on the rail, a second or movable jaw coupled to the first jaw for movement between an open position and a closed position, a resilient member that is forced against the rail when the second jaw is moved to the closed position to inhibit the movement of the clamp along the rail, and a latch coupled to the second jaw and movable relative to the second jaw between a latched position in which the second jaw is latched in the closed position relative to the first jaw and an unlatched position in which the second jaw is movable between the open and closed positions.

In some embodiments, the first jaw is integrally formed with an associated accessory. The first jaw may have an aperture in which the resilient member is received. The first jaw may be configured to hook onto a first portion of the rail and the second jaw may be configured to hook onto a second portion of the rail when in the closed position. The second jaw may be coupled to the first jaw for pivoting movement about an axis that is generally parallel to the rail. The latch may be coupled to the second jaw for pivoting movement about an axis that is generally parallel to the rail. The latch may be biased toward the latched position by a spring. The spring may be received in an aperture in the second jaw. The latch may have a protruding portion and the first jaw may have a recess in which the protruding portion of the latch is received when the second jaw is in the closed position and the latch is in the latched position. The first jaw, the second jaw, the resilient member, and the latch are each made from a radiolucent material.

The clamp may further comprise a disk that is secured to the resilient member and that is made from a material that is harder than the resilient member. The second jaw may contact the disk when moving from the first position to the second position. The resilient member may be received in an aperture in the second jaw and at least a portion of the disk may be situated outside the aperture on one side of the first jaw. At least portion of the resilient member may be situated outside the aperture on an opposite side of the first jaw. The aperture and the resilient member may each have a stepped configuration to prevent the resilient member and disk from falling out of the aperture in a first direction. A portion of the second jaw may overlap the disk to prevent the resilient member and jaw from falling out of the aperture in a second direction.

The rail to which the clamp couples may be quadrilateral in cross section having a top, bottom, and opposite sides. The first jaw may be configured to overlap at least a portion of the top and opposite sides of the rail and the second jaw may be configured to overlap at least a portion of the top, the bottom, and one of the sides of the rail when in the second position. The latch may be coupled to the first jaw so as to pivot downwardly when moving form the latched position to the unlatched position and the first jaw may be coupled to the second jaw so as to pivot upwardly when pivoting between the second position and the first position.

The second jaw may have a cutout in which at least a portion of the latch is received. The second jaw may have an arm on each side of the cutout and the latch may be coupled to the second jaw by a pivot pin having end regions received in bores formed in each of the arms of the second jaw and having a middle region received in a bore formed in the latch. The first jaw may have a protrusion that substantially fills at least a portion of the cutout when the second jaw is in the second position. The second jaw may have an arm on each side of the cutout and the second jaw is coupled to the first jaw by a pivot pin having end regions received in bores formed in each of the arms of the second jaw and having a middle region received in a bore formed in the protrusion of the first jaw.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
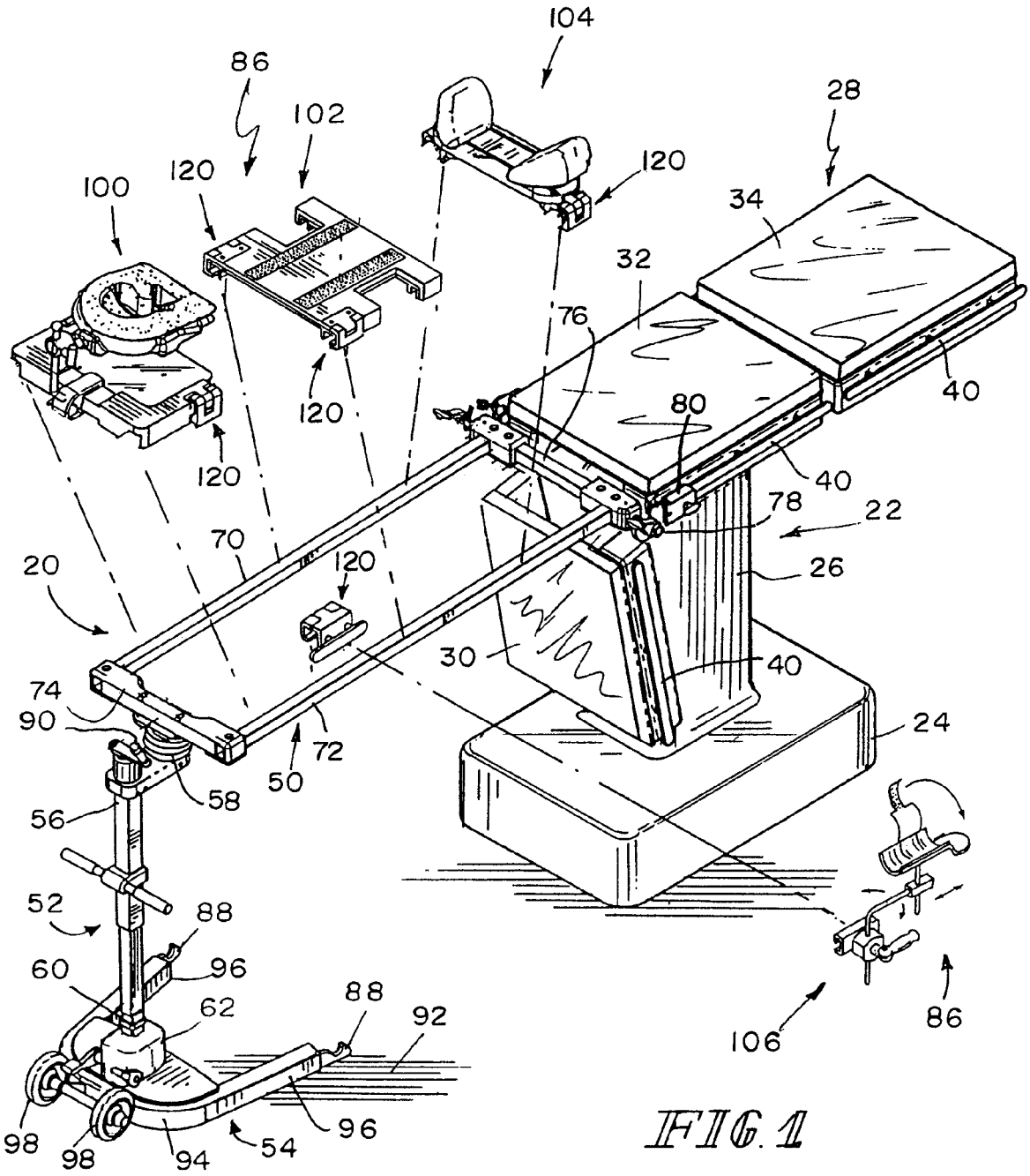
FIG. 1 is a perspective view of a spinal surgery extension coupled to a surgical table showing a plurality of patient support accessories having associated clamps exploded away from the spinal surgery extension.

As shown in FIG. 1, a spinal surgery extension 20 is coupled to a surgical table 22. Illustratively, the surgical table 22 has a base 24, a pedestal 26, and a patient support deck 28. The deck 28 includes a head section 30, a seat section 32, and a foot section 34. The head and foot sections 30, 34 are pivotably coupled to the seat section 32 about respective transverse axes. Each deck section 30, 32, 34 includes two accessory rails 40 on opposite sides thereof. The deck 28 is pivotable about a transverse axis between Trendelenberg and reverse Trendelenberg positions. In addition, the deck 28 is pivotable about a longitudinal axis. In FIG. 1, the head section 30 is pivoted downwardly to an out-of-the-way position so that the spinal surgery extension 20 can be attached to a head end 46 of the surgical table 22.

The spinal surgery extension 20 includes a generally rectangular frame 50, an adjustable telescopic support 52, and a generally U-shaped base 54. An upper end 56 of the telescopic support 52 is coupled to the frame 50 by a universal joint 58 and a lower end 60 of the telescopic support 52 is coupled to the base 54 by a ball joint 62. The rectangular frame 50 includes left and right longitudinally-extending transversely-spaced side rails 70, 72 and head and foot end cross rails 74, 76 extending transversely between the rails 70, 72 near head and foot ends of the frame 50. The head end cross rail 74 is coupled to the telescopic support 52 via the universal joint 58. Two pivot shafts 78 extend outwardly from the foot end cross rail 76. The pivot shafts 78 are supported by associated rail clamps 80 secured to the accessory rails 40 of the seat section 32 of the surgical table 22. The pivot shafts 78 allow the frame 50 to pivot about a transverse axis relative to the surgical table 22.

The rails 70, 72 and the cross rails 74, 76 of the frame 50 have a generally rectangular cross section. In the illustrative embodiment, the rails 70, 72, 74, 76 are each about 1.5 inches (about 3.81 centimeters) high and about 1.25 inches (about 3.175 centimeters) wide. The inside spacing between the rails 70, 72 is about 14.5 inches (about 36.83 centimeters). The inside spacing between the cross rails 74, 76 is about 48.5 inches (about 123.2 centimeters). The rails 70, 72, 76 are made from radiolucent material, such as carbon fiber tube with a foam core, so that they do not interfere with x-ray imaging of a patient supported in a prone position on the frame 50 during spinal surgery. Frame member 74 and corner connectors 77 which interconnect member 76 with members 70, 72 and from which shafts 78 extend are made of a metal in the illustrative embodiment.

The telescopic support 52 includes a crank handle 90 which is operable to vary the height of the head end of the frame 50 between about 30 inches (about 76.2 centimeters) and about 42 inches (about 106.68 centimeters) above a floor 92. The U-shaped base 54 includes a bight portion 94 and two spaced-apart legs 96 which flare outwardly. When the frame 50 is attached to the surgical table 22, the legs 96 extend toward the surgical table as shown in FIG. 1. Two wheels 98 are coupled to the bight portion 94 such that the wheels 98 are spaced from the floor when the legs 96 are resting on the floor 92. Each leg 96 has a hook 88 at its free end. For storage, the frame 50 is detached from the surgical table 22 and folded downwardly so that the pivot shafts 78 are received in the respective hooks 88. The telescopic support 52 is extended by an amount that permits pivot shafts 78 to be received by the hooks 88. The extension 20 can be tilted so that wheels 98 engage the floor 92 and the assembly can then be rolled along the floor 92 for transport.

As shown in FIG. 1, a plurality of accessories 86 for supporting a patient on the frame 650 are adapted to be coupled to the longitudinally-extending rails 70, 72 of the frame 50 by associated clamps 120. Illustrative examples of such accessories includes a head support apparatus 100, a panel 102 which may support a mattress pad, a body support apparatus 104, and an arm support apparatus 106. Other accessories may be coupled to the rails 70, 72 of the frame 50 by associated clamps 120.

The spinal surgery extension 20, panel 102, and arm support apparatus 106 are described in further detail in U.S. patent application Ser. No 11/402,330, entitled "Accessory Frame for Spinal Surgery," and filed concurrently herewith, which is also hereby incorporated by reference herein. The head support apparatus 100 is described in further detail in U.S. patent application Ser. No. 11/402,332, entitled "Head Support Apparatus for Spinal Surgery," and filed concurrently herewith, which is hereby incorporated by reference herein. The body support apparatus 104, as well as other body support apparatuses which are coupleable to frame members 70, 72, are described in further detail in U.S. patent application Ser. No. 11/402,327, entitled "Body Support Apparatus for Spinal Surgery," and filed concurrently herewith, which is hereby incorporated by reference herein.

The foregoing is provided merely as an example of one of the types of structures to which clamps 120 may couple and to provide some examples of the types of devices which may include clamps 120. While the illustrative clamps 120 are sized and configured for coupling to the frame members of Jackson tables as well as to extension 20, it should be appreciated that other clamps according to this disclosure may be designed with the features of clamp 120, but yet sized and configured for coupling to frame members or rails of any desired size.

As shown in FIGS. 2-6, each clamp 120 includes a first or fixed jaw 122, a second or movable jaw 124, a resilient member 126, and a finger latch 128. The first jaw 122, which is integrated into or otherwise coupled to the patient support accessories 100, 102, 104, 106, is adapted to be placed on an associated rail 70, 72 of the frame 50. In some embodiments, at least the jaws 122, 124 are made from a radiolucent material, such as an acrylonitrile butadiene styrene resin (ABS) material, an acetal resin material such as DELRIN® material, or the like. In some embodiments, the finger latch 128 may be made from polyethylene. In other embodiments, various portions of clamp 120 may be made from other radiolucent materials such as polyester, polyurethane, polyethylene, ultra-high-molecular-weight (UHMW) polyethylene, or other resin based materials. In the illustrative embodiment, the jaws 122, 124, the resilient member 126, and the latch 128 are each made from a radiolucent material. Also in the illustrative embodiment, the first jaw 122 is integrally molded with the associated accessory 100, 102, 104, 106. In other embodiments, the first jaw 122 may be separately formed, and coupled to the associated accessory 100, 102, 104, 106 by suitable fasteners, such as pins, screws, nut and bolt combinations, or the like.

Figure 2:
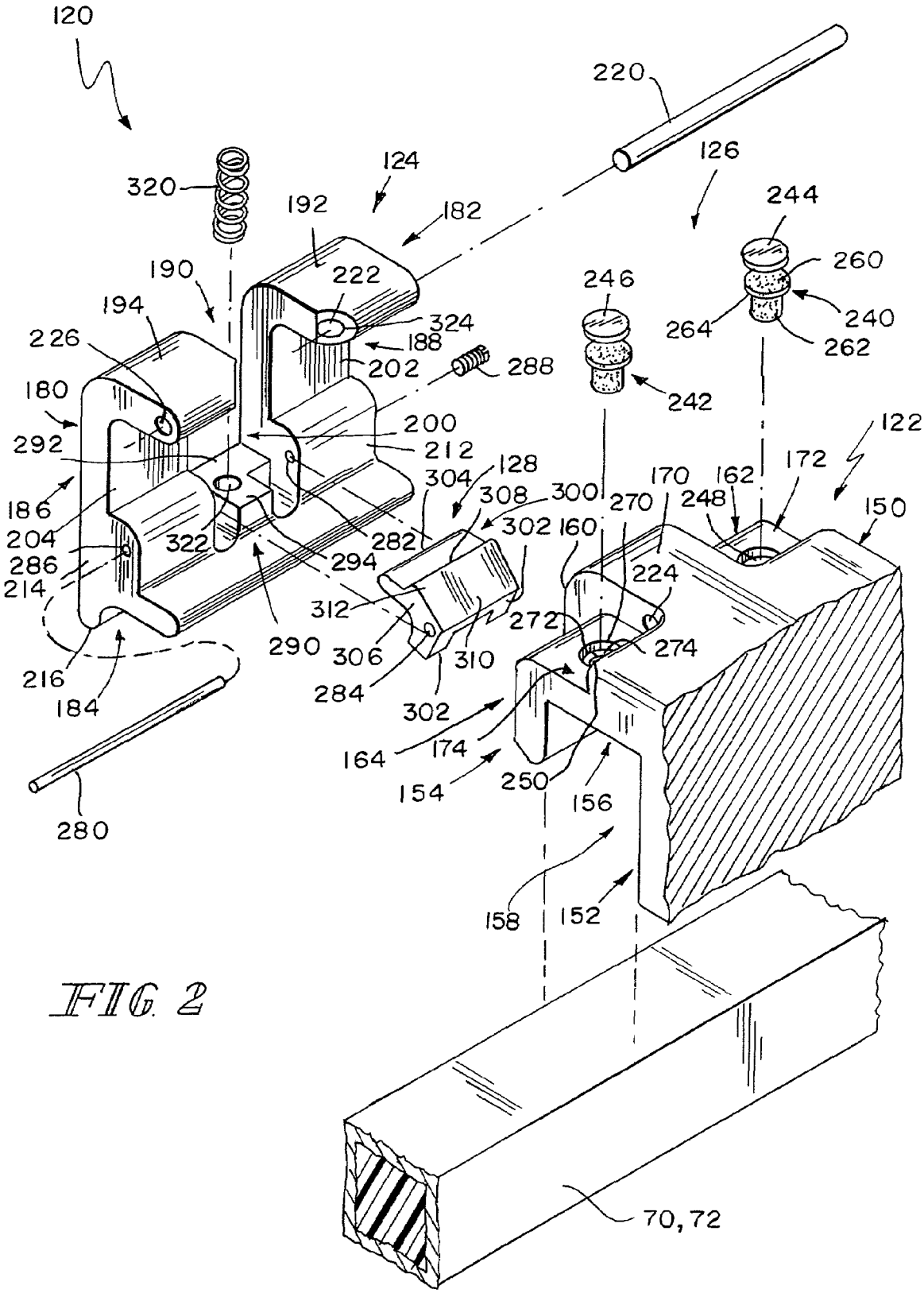
FIG. 2 is an exploded perspective view of a clamp showing a first jaw, a second jaw, a pivot pin for pivotably coupling the second jaw to the first jaw, a pair of urethane friction buttons, a latch, a pivot pin for pivotably coupling the latch to the second jaw, and a spring for biasing the latch toward a latched position.
Figure 3:
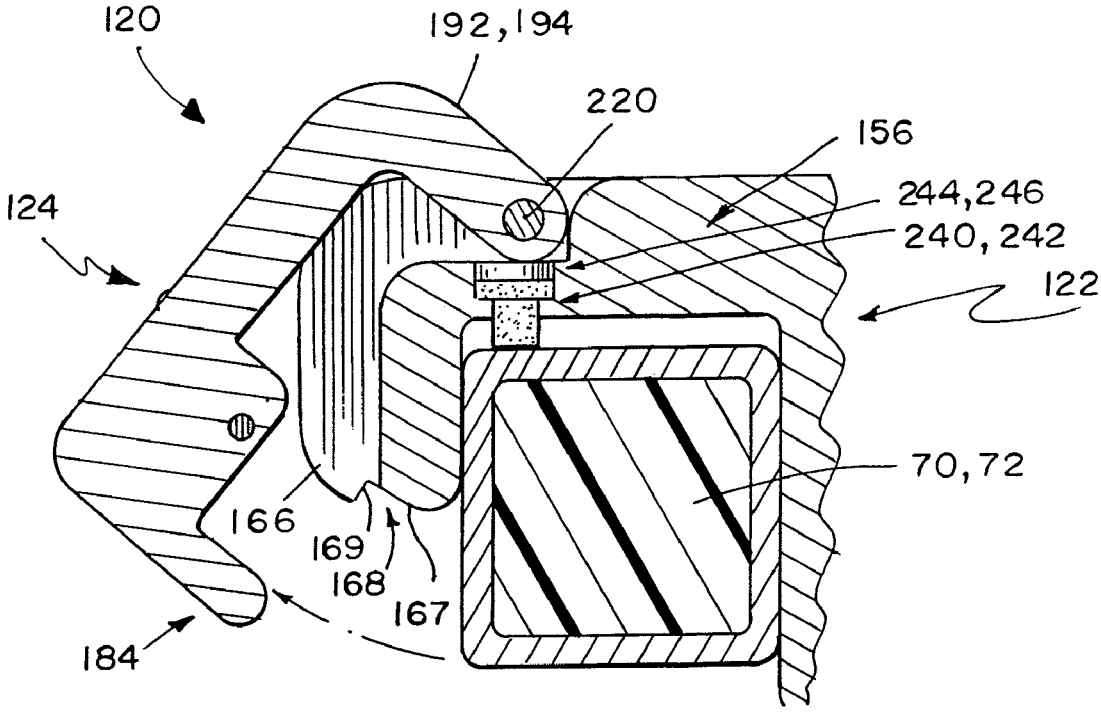
FIG. 3 is a cross sectional view of the clamp through a urethane friction button with the second jaw of the clamp in an open position.
Figure 4:
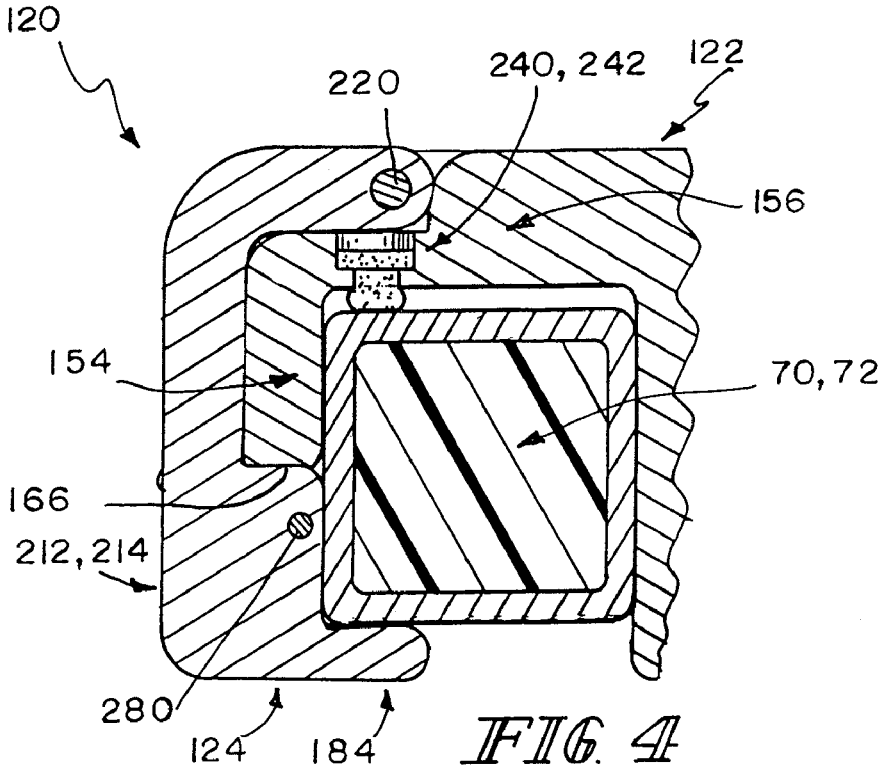
FIG. 4 is a cross sectional view of the clamp through a urethane friction button with the second jaw of the clamp in a closed position.

As shown in FIG. 2, the first jaw 122 has a U-shaped body 150 having inner and outer downwardly-extending leg portions 152, 154 and a bight portion 156 extending transversely between the inner and outer downwardly-extending leg portions 152, 154. The body portions 152, 152, 156 define a downwardly-opening channel 158 for receiving a portion of the rail 70, 72. In the illustrative embodiment, the outer leg portion 154 is shorter than the inner leg portion 152. The outer leg portion 154 has a step portion 160 disposed between two longitudinally-spaced outwardly-opening recessed portions 162, 164. As shown in FIG. 3, the downwardly-facing surface 166 of the outer leg portion 154 defines a downwardly-opening recess 168. The recess 168 has an outwardly-facing surface 167 and an inwardly-facing surface 169. The bight portion 156 has a step portion 170 disposed between two longitudinally-spaced upwardly-opening recessed portions 172, 174.

Still referring to FIG. 2, the second jaw 124 includes a U-shaped body 180 having upper and lower inwardly-extending arm portions 182, 184 and a bight portion 186 extending generally vertically between the upper and lower inwardly-extending arm portions 182, 184. The body portions 182, 182, 186 define an inwardly-opening channel 188 for receiving a portion of the rail 70, 72. The upper arm portion 182 has a cutout 190 disposed between two longitudinally-spaced step portions 192, 194. The bight portion 186 has a cutout 200 disposed between two longitudinally-spaced step portions 202, 204. The cutouts 190, 200 in the portions 182, 186 of the second jaw 124 are in communication with each other. The lower portions of the step portions 202, 204 of the bight portion 186 are more thick than the associated upper portions to create two inwardly-extending ledge portions 212, 214. The inwardly-extending arm portion 184 is formed to include a grip portion 216 to allow a user to pivot the second jaw 124 to the open position after releasing the finger latch 128.

Figure 5:
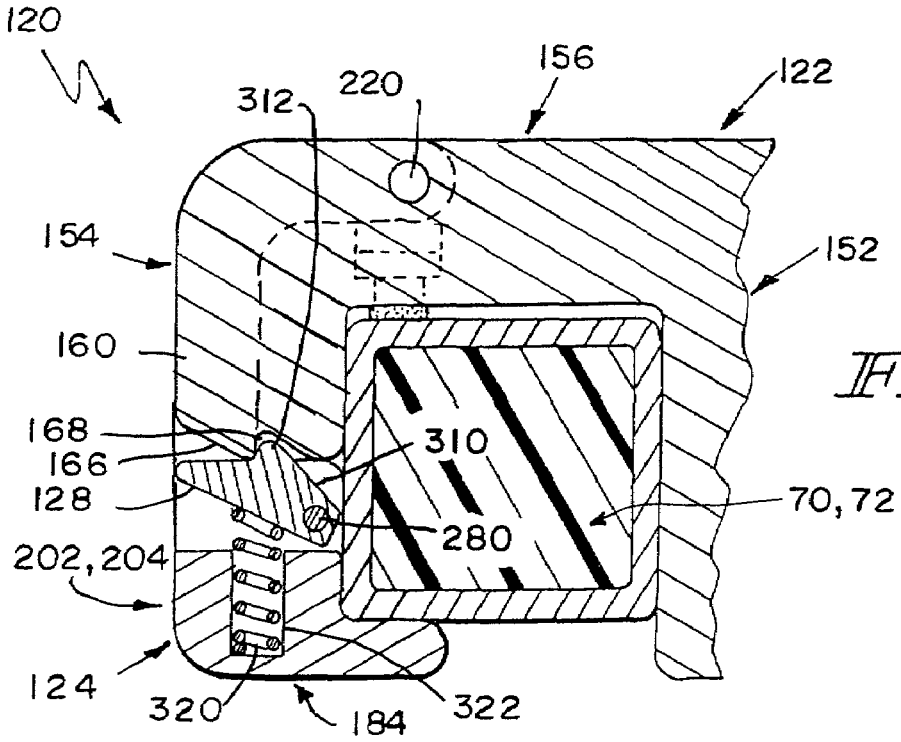
FIG. 5 is a cross sectional view of the clamp through the latch with the second jaw of the clamp in the closed position and the latch biased toward a latched position by a spring.

The second jaw 124 is coupled to the first jaw 122 for pivoting movement about a longitudinally-extending pivot pin 220 between a first unlocked or open position spaced from the first jaw 122 as shown in FIG. 3 and a second locked or closed position adjacent the first jaw 122 as shown in FIG. 5. The pivot pin 220 extends through a bore 222 in the step portion 192 of the second jaw 124, through a bore 224 in the step portion 170 of the first jaw 122, and through a bore 226 in the step portion 194 of the second jaw 124. The bores 222, 224, 226 are coaxially aligned with the pivot pin 220. In the illustrative embodiment, set screws, similar to the set screws 288, are threaded into the bores 222, 226 in the step portions 192, 194 so that outer surfaces of the set screws are flush with outer surfaces of the respective step portions 192, 194. These set screws retain pin 220 within bores 222, 224, 226.

When the second jaw 124 is in the closed position as shown, for example, in FIG. 5, the associated rail 70, 72 of the frame 50 is captured between the bight portion 156 of the first jaw 122, the downwardly-extending leg portions 152, 154 of the first jaw 122, the step portions 202, 204 of the second jaw 124, and the inwardly-extending arm portion 184 of the second jaw 124. The jaws 122, 124 are dimensioned so that the outer surfaces of the jaws 122, 124 are flush with each other when the second jaw 124 is in the closed position as shown in FIG. 5. Thus, when the second jaw 124 is in the closed position, (1) the step portion 160 of the first jaw 122 is received in the cutout 200 in the second jaw 124, (2) the step portion 170 of the first jaw 122 is received in the cutout 190 in the second jaw 124, (3) the step portions 192, 194 of the second jaw 124 are received in the associated recessed portions 172, 174 in the first jaw 122, (4) the step portions 202, 204 of the second jaw 124 are received in the associated recessed portions 162, 164 in the first jaw 122, and (5) the ledge portions 212, 214 of the second jaw 124 are wedged underneath the downwardly-facing surface 166 of the outer leg portion 154 as shown, for example, in FIG. 4.

In the illustrative embodiment, as shown in FIG. 2, the resilient member 126 comprises a pair of urethane friction buttons 240, 242. Discs 244, 246 made from relatively hard material are secured to the top surfaces of the associated friction buttons 240, 242. In the illustrative embodiment, the discs 244, 246 are secured to the friction buttons 240, 242 by a drop of Loctite® 416 adhesive. The friction buttons 240, 242, with the discs 244, 246 secured thereto, are received in respective openings 248, 250 in the bight portion 156 of the first jaw 122. As the second jaw 124 pivots from the open position, shown in FIG. 3, to the closed position, shown in FIG. 4, the downwardly-facing surfaces of the step portions 192, 194 of the second jaw 124 press down on the discs 244, 246 to, in turn, cause the friction buttons 240, 242 to press down on the associated rail 70, 72 with sufficient force to inhibit movement of the clamp 120 along the associated rail 70, 72.

In the illustrative embodiment, the friction buttons 240, 242 each comprise a large diameter head portion 260, a small diameter body portion 262, and an annular seat portion 264 at the juncture of the large and small diameter portions 260, 262. The openings 248, 250 each have a large diameter bore 270, a small diameter bore 272, and an annular seat portion 274 at the juncture of the large and small diameter bores 270, 272. The seat portions 264 of the friction buttons 240, 242 are configured to engage the seat portions 274 of the openings 248, 250 to prevent the friction buttons 240, 242 from falling downwardly through the openings 248, 250 when the friction buttons 240, 242 are not supported by the associated rail 70, 72 and the clamp 120 is the orientation shown in FIGS. 3 and 4. On the other hand, the step portions 192, 194 of the second jaw 124 in the regions adjacent pin 220 prevent the friction buttons 240, 242 from falling out of the openings 248, 250 when the clamp 120 is turned upside down.

The friction buttons 240, 242 and the associated discs 244, 246 are dimensioned such that, when the friction buttons 240, 242 are supported by the associated rail 70, 72, the friction buttons 240, 242 protrude below the downwardly-facing surfaces of the bight portion 156 of the first jaw 122 as shown in FIG. 3, so that as the second jaw 124 pivots from the open position (FIG. 3) to the closed position (FIG. 4), the step portions 192, 194 of the second jaw 124 press down on the discs 244, 246 to cause the friction buttons 240, 242 to press down on the associated rail 70, 72 (FIG. 4) to inhibit movement of the clamp 120 along the associated rail 70, 72. In the illustrative embodiment, the discs 244, 246 and the head portions of the friction buttons 240, 242 have the same diameter. The friction buttons 240, 242, the associated discs 244, 246, and the pivotable jaw 124 cooperate to form a lock mechanism for inhibiting movement of the clamp 120 along the associated rail 70, 72 when jaw 124 is in the closed position.

Figure 6:
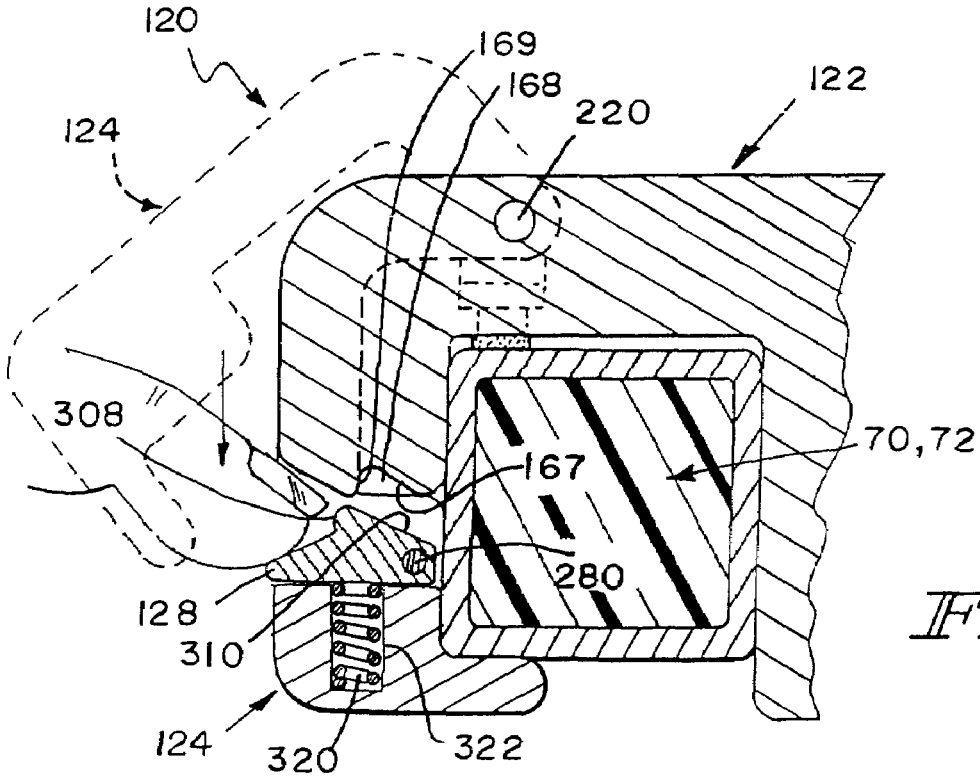
FIG. 6 is a cross sectional view of the clamp through the latch with the second jaw of the clamp in the closed position and the latch pivoted to an unlatched position.

The finger latch 128 is coupled to the second jaw 124 for pivoting movement about a longitudinally-extending pivot pin 280 between a first or latched position, shown in FIG. 5, and a second or unlatched position, shown in FIG. 6. Referring to FIG. 2, the pivot pin 280 extends through a bore 282 in the ledge portion 212 of the second jaw 124, through a bore 284 in the latch 128, and through a bore 286 in the ledge portion 214 of the second jaw 124. The bores 282, 284, 286 are coaxially aligned with the pivot pin 280. In the illustrative embodiment, set screws 288 are threaded into the openings 282, 286 in the ledge portions 212, 214 so that outer surfaces of the set screws 288 are flush with outer surfaces of the respective ledge portions 212, 214 of the second jaw 124. Set screws 288 retain pin 280 in bores 282, 284, 286.

As shown in FIG. 2, the inwardly-extending lower arm portion 184 of the second jaw 124 has a step portion 290 that extends upwardly into the cutout 200 in the bight portion 186 of the second jaw 124. An outer portion 292 of the step portion 290 has a first width and an inner portion 294 of the step portion 290 has a second width that is less than the first width. The latch 128 has a body portion 300, a pair of longitudinally-spaced leg portions 302 that extend downwardly from the body portion 300, a finger grip portion 304 that extends forwardly from the body portion 300, and a protruding portion 306 that extends upwardly from the body portion 300. The protruding portion 306 has an outwardly-facing surface 308 and an inwardly-facing surface 310. When the latch 128 is positioned in the cutout 200 with the pivot pin 280 extending through the opening 282 in the ledge portion 212 of the second jaw 124, the opening 284 in the latch 128 and the opening 286 in the ledge portion 214 of the second jaw 124, the leg portions 302 of the latch 128 straddle the reduced-width inner portion 294 of the step portion 290. The latch 128 is normally biased toward the latched position, shown in FIG. 5, by a spring 320 that is received in an opening 322 in the step portion 290 and that is maintained in a state of compression between latch 128 and jaw 124.

As the second jaw 124 moves to the closed position shown in FIG. 5, the downwardly-facing surface 166 of the step portion 160 of the first jaw 122 engages the inwardly-facing surface 310 of the protruding portion 306 of the latch 128 to initially cause the latch 128 to pivot downwardly. As the second jaw 124 arrives at the closed position, shown in FIG. 5, the spring 320 causes the latch 128 to move upwardly so that a tip 312 of the protruding portion 306 of the latch 128 is received in the recess 168 (FIG. 6) in the downwardly-facing surface 166 of the step portion 160 of the first jaw 122 with the inwardly-facing surface 169 (FIG. 6) of the recess 168 and the outwardly-facing surface 308 (FIG. 6) of the protruding portion 306 disposed in a confronting relationship. When the latch 128 is pivoted to the unlatched position as shown in FIG. 6, the second jaw 124 is free to move to the open position as shown in phantom in FIG. 6. The corner portions of various parts are rounded or chamfered, as at 324 in FIG. 2, to facilitate assembly of the parts and avoid any jamming of the parts during operation.

Based on the foregoing, it should be appreciated that clamps 120 attach to and detach from rails 70, 72 in a quick and easy manner. To attach clamps 120 to rails 70, 72, jaw 122 is placed on the one of rails 70, 72 and then jaw 124 is pivoted downwardly from the opened position to the closed position. As jaw 124 moves to the closed position, resilient members 240, 242 are automatically forced against the rail 70, 72 to prevent the clamp 120 from moving along the rail and latch 128 automatically snaps into its locked position to retain jaw 124 in the closed position. To remove clamp 120 from the rail 70, 72 to which it is coupled, latch 128 is pivoted to its unlatched position and jaw 124 is pivoted upwardly to its open position. For example, a user may move latch 128 downwardly to its unlatched position by pressing downwardly on portion 304 of latch 128 with his or her thumb and the user may move jaw 124 to its open position by pulling upwardly on portion 216 of jaw 124 with his or her fingers.

Although certain illustrative embodiments have been described in detail above, variations and modifications exist within the scope and spirit of this disclosure as described and as defined in the following claims.

The invention claimed is:

1. A clamp for securing to a rail of a patient support apparatus, the clamp comprising a first jaw adapted to be placed on the rail, a second jaw coupled to the first jaw for pivoting movement relative to the first jaw about a first axis between a first position and a second position, a resilient member that is forced against the rail in response to the second jaw being moved from the first position to the second position, the resilient member engaging the rail with sufficient force to inhibit movement of the clamp along the rail when the second jaw is in the second position, and a latch coupled to the second jaw for pivoting movement relative to the second jaw about a second axis between a latched position in which the second jaw is latched in the second position relative to the first jaw and an unlatched position in which the second jaw is movable between the first and second positions, the second axis being spaced from and substantially parallel with the first axis.

2. The clamp of claim 1, wherein the first jaw has an aperture in which the resilient member is received.

3. The clamp of claim 1, wherein the first jaw is configured to hook onto a first portion of the rail and the second jaw is configured to hook onto a second portion of the rail when in the second position.

4. The clamp of claim 1, wherein the first axis is generally parallel to a length dimension of the rail.

5. The clamp of claim 1, wherein the second axis is generally parallel to a length dimension of to the rail.

6. The clamp of claim 1, wherein the latch is biased toward the latched position.

7. The clamp of claim 6, wherein the latch is biased toward the latched position by a spring.

8. The clamp of claim 1, wherein the latch has a protruding portion and the first jaw has a recess in which the protruding portion is received when the second jaw is in the second position and the latch is in the latched position.

9. The clamp of claim 1, wherein the first jaw, the second jaw, the resilient member, and the latch are each made from a radiolucent material.

10. The clamp of claim 1, further comprising a disk that is secured to the resilient member and that is made from a material that is harder than the resilient member, the second jaw contacting the disk when moving from the first position to the second position.

11. The clamp of claim 10, wherein the resilient member is received in an aperture in the second jaw, at least a portion of the disk is situated outside the aperture on one side of the first jaw, at least portion of the resilient member is situated outside the aperture on an opposite side of the first jaw.

12. The clamp of claim 1, wherein the second jaw has a cutout in which at least a portion of the latch is received.

13. The clamp of claim 1, wherein the first jaw is configured to overlap at least a portion of a top and opposite sides of the rail and the second jaw is configured to overlap at least a portion of the top, a bottom and one of the sides of the rail when in the second position.

14. The clamp of claim 1, wherein the latch is coupled to the first jaw so as to pivot downwardly when moving from the latched position to the unlatched position and the first jaw is coupled to the second jaw so as to pivot upwardly when pivoting between the second position and the first position.

15. A clamp for securing to a rail of a patient support apparatus, the clamp comprising a first jaw adapted to be placed on the rail, a second jaw coupled to the first jaw for movement between a first position and a second position, a resilient member that is forced against the rail when the second jaw is moved from the first position to the second position. the resilient member engaging the rail with sufficient force to inhibit movement of the clamp along the rail when the second jaw is in the second position, a latch coupled to the second jaw and movable relative to the second jaw between a latched position in which the second jaw is latched in the second position relative to the first jaw and an unlatched position in which the second jaw is movable between the first and second positions, and a disk that is secured to the resilient member and that is made from a material that is harder than the resilient member, the second jaw contacting the disk when moving from the first position to the second position, wherein the resilient member is received in an aperture in the second jaw, at least a portion of the disk is situated outside the aperture on one side of the first jaw, at least portion of the resilient member is situated outside the aperture on an opposite side of the first jaw, wherein the aperture and the resilient member have a stepped configuration to prevent the resilient member and disk from falling out of the aperture in a first direction and a portion of the second jaw overlaps the disk to prevent the resilient member and jaw from falling out of the aperture in a second direction.

16. A clamp for securing to a rail of a patient support apparatus, the clamp comprising a first jaw adapted to be placed on the rail, a second jaw coupled to the first jaw for movement between a first position and a second position, a resilient member that is forced against the rail when the second jaw is moved from the first position to the second position, the resilient member engaging the rail with sufficient force to inhibit movement of the clamp along the rail when the second jaw is in the second position, and a latch coupled to the second jaw and movable relative to the second jaw between a latched position in which the second jaw is latched in the second position relative to the first jaw and an unlatched position in which the second jaw is movable between the first and second positions, wherein the second jaw has a cutout in which at least a portion of the latch is received, wherein the second jaw has an arm on each side of the cutout and the latch is coupled to the second jaw by a pivot pin having end regions received in bores formed in each of the arms of the second jaw and having a middle region received in a bore formed in the latch.

17. A clamp for securing to a rail of a patient support apparatus, the clamp comprising a first jaw adapted to be placed on the rail, a second jaw coupled to the first jaw for movement between a first position and a second position, a resilient member that is forced against the rail when the second jaw is moved from the first position to the second position, the resilient member engaging the rail with sufficient force to inhibit movement of the clamp along the rail when the second jaw is in the second position, and a latch coupled to the second jaw and movable relative to the second jaw between a latched position in which the second jaw is latched in the second position relative to the first jaw and an unlatched position in which the second jaw is movable between the first and second positions, wherein the second jaw has a cutout in which at least a portion of the latch is received, wherein the first jaw has a protrusion that substantially fills at least a portion of the cutout when the second jaw is in the second position.

18. The clamp of claim 17, wherein the second jaw has an arm on each side of the cutout and the second jaw is coupled to the first jaw by a pivot pin having end regions received in bores formed in each of the arms of the second jaw and having a middle region received in a bore formed in the protrusion of the first jaw.

* * * * *